US006412189B1

(12) United States Patent
Pellinen

(10) Patent No.: US 6,412,189 B1
(45) Date of Patent: Jul. 2, 2002

(54) STEAM BOX OF A PAPER MACHINE

(75) Inventor: Kari Pellinen, Säynätsalo (FI)

(73) Assignee: Metso Paper Automation Oy, Tampere (FI)

( * ) Notice: Subject to any disclaimer, the term of this patent is extended or adjusted under 35 U.S.C. 154(b) by 0 days.

(21) Appl. No.: 09/691,362

(22) Filed: Oct. 18, 2000

(51) Int. Cl.[7] ..... D06F 58/00

(52) U.S. Cl. ..... 34/114; 34/119; 34/122; 34/124; 34/629; 34/636

(58) Field of Search ..... 34/114, 119, 122, 34/124, 130, 623, 624, 629, 636, 638; 162/272, 275, 290, 375

(56) References Cited

U.S. PATENT DOCUMENTS

| | | | | | |
|---|---|---|---|---|---|
| 4,268,976 | A | * | 5/1981 | Dove | 34/636 |
| 4,320,583 | A | | 3/1982 | Dove | |
| 4,351,700 | A | | 9/1982 | Dove | |
| RE31,065 | E | * | 10/1982 | Shelor | 229/120 |
| 4,358,900 | A | * | 11/1982 | Dove | 34/568 |
| 4,662,398 | A | | 5/1987 | Wywailowski et al. | |
| 4,915,788 | A | | 4/1990 | Winheim | |
| 5,059,285 | A | | 10/1991 | Winheim | |
| 5,282,323 | A | * | 2/1994 | Winheim | 34/629 |
| 5,355,595 | A | * | 10/1994 | Koivukunnas et al. | 34/570 |
| 5,416,980 | A | | 5/1995 | Ivespää | |
| 5,749,158 | A | * | 5/1998 | Muller et al. | 34/119 |
| 5,752,324 | A | * | 5/1998 | Muller et al. | 34/114 |
| 6,178,661 | B1 | * | 1/2001 | Muller et al. | 34/487 |

FOREIGN PATENT DOCUMENTS

CA 2185891 A1 7/1996

* cited by examiner

*Primary Examiner*—Denis L. Esquivel
*Assistant Examiner*—Mark Sulman
(74) *Attorney, Agent, or Firm*—Alston & Bird LLP

(57) ABSTRACT

A steam box in a paper machine, the steam box including a main steam zone and at least one side steam zone through which steam is blown to a paper web. The side steam zone is placed in a side section of the steam box and arranged to form a curtain in order to prevent air from entering between the steam box and the paper web from outside the steam box and/or to prevent steam from exiting between the steam box and the paper web. Steam is supplied to the side steam zone from a steam chamber through a side steam zone valve arranged inside the steam box.

18 Claims, 2 Drawing Sheets

STEAM BOX OF A PAPER MACHINE

FIELD OF THE INVENTION

The invention relates to a steam box for a paper machine, the steam box comprising a steam chamber, a main steam zone, and at least one side steam zone, wherein steam is supplied to the main steam zone from the steam chamber, and also including at least one adjustable side steam zone valve through which steam is supplied to the side steam zone.

BACKGROUND OF THE INVENTION

A paper machine utilizes steam boxes for blowing steam against a paper web. Among other things, the steam boxes enable the capacity of the paper machine to be increased. A steam box may be arranged, for example, in a press section and/or a wire section of the paper machine, whereby the steam box may be used, for example, for increasing the temperature of the paper web, and thereby press nips and dewatering equipment can remove warmed water more easily; consequently, the dry solids content can be increased and the drying capacity of the drying section improved. Furthermore, if desired, the steam box may even be used for correcting the moisture profile of the paper web. The steam boxes may also be used in many other parts of the paper machine, such as the drying section, calender section and paper converting machines.

U.S. Pat. No. 4,662,398 discloses a steam box of a paper machine wherein steam is supplied through a steam supply pipe to a steam chamber inside the steam box. In a cross direction of the web, the steam box is divided into adjacent chambers, and steam is supplied to each chamber from the steam chamber through chamber-specific and adjustable valves. Each chamber comprises a diffusion plate through which the steam is allowed to affect the paper web. The valves enable the amount of steam flowing into each chamber to be controlled chamber-specifically, thus enabling the cross direction profile of the paper web also to be adjusted.

FI publication 963 583 discloses a steam box of a paper machine wherein the valves controlling the amount of steam are arranged outside the steam box, and steam is supplied to each chamber through a separate, chamber-specific pipe. The pipes, however, cause rather great flow and temperature losses, so it is extremely difficult and unreliable to adjust the cross direction profile of the paper web by using the steam box at issue.

In the above-disclosed solutions, cold air is carried along the paper web, for example, between the paper web and the steam box, which decreases the effect of the steam on the paper web and makes the cross direction profile of the paper web more difficult to adjust. This problem has been solved in a known steam box such that in addition to the actual main steam zone, the steam box comprises at least one side steam zone. The tasks of the steam box, i.e. increasing the capacity of the paper machine and/or correcting the moisture profile of the paper web, for example, are implemented mainly by using the main steam zone. The side steam zone is located within the steam box prior to the main steam zone in the direction of travel of the web. By utilizing steam, a curtain is formed by the side steam zone to prevent air from being carried along with the web between the steam box and the paper web. The side steam zone may also be used for preheating the paper web and for correcting a potentially distorted moisture profile of the paper web. The side steam zone may also be located after the main steam zone in the direction of travel of the web, in which case the purpose of the side steam zone is to prevent the steam supplied to the main steam zone from escaping from between the web and the steam box.

U.S. Pat. Nos. 4,915,788 and 5,059,285 disclose a steam box to be arranged in the wire section of a paper machine. As seen in the direction of travel of the web, the steam box comprises three steam zones from which steam is supplied against the web. The front and rear sides of the steam box comprise side steam zones and a main steam zone therebetween. The purpose of the side steam zones is to prevent steam from exiting between the steam box and the web. Steam is supplied to the side steam zones through a chamber, to which chamber, in turn, steam is supplied through apertures in the wall of a steam chamber of the steam box. The solution cannot be used for adjusting the amount of steam supplied by the side steam zone, which would be necessary when, for example, the grade of the manufactured paper or the speed of the paper machine changes.

It is thus known to supply steam to the chamber supplying steam in the side steam zone by conveying the steam from the steam supply pipe of the steam box through a channel outside the steam box. An adjustable valve is arranged in the channel, either outside or inside the steam box. The valve is manually adjustable because the channels outside the steam box take space and no valves of different kind would fit in the space reserved for the steam box in a paper machine. Furthermore, the extremely difficult conditions surrounding the paper machine also affect the valve outside the steam box; hence, strict requirements are thus set for the structure of the valves, which also need quite extensive maintenance. The valve placed inside the steam box is particularly difficult to adjust since it does require the steam box to be shut down, cooled and opened in order to enable adjustments to be carried out in the first place.

SUMMARY OF THE INVENTION

A steam box of the invention is characterized in that steam is arranged to be supplied to the side steam zone through the side steam zone valve from the steam chamber, and that the side steam zone valve is arranged inside the steam box.

In accordance with the invention, a steam box comprises a main steam zone and at least one side steam zone through which steam is blown to a paper web, and the side steam zone is located in a side section of the steam box and is operable to form a curtain to prevent air from entering between the steam box and the paper web from outside the steam box and/or to prevent steam from exiting between the steam box and the paper web. Steam is supplied to the side steam zone from a steam chamber of the steam box through an adjustable valve, the valve being arranged inside the steam box. In a first preferred embodiment of the invention, the valve for adjusting the amount of steam supplied to the side steam zone is operable to be adjusted by a remotely controlled actuator. In accordance with a second preferred embodiment, the actuator for the valve adjusting the amount of steam supplied to the side steam zone is arranged in the same space inside the steam box as actuators adjusting the valves of the main steam zone. In a third preferred embodiment, the valve adjusting the amount of steam supplied to the side steam zone is arranged in the steam chamber of the steam box.

An advantage of the invention is that the solution in its entirety takes reasonably little space. The steam box has a simple structure and, arranged inside the steam box, the valves are protected against the difficult conditions surrounding the paper machine. Furthermore, a remotely controlled actuator may be arranged in connection with the valve adjusting the side steam zone, which means that in order to adjust said valve, it is unnecessary to stop the entire paper machine, such that the adjustment can be automatically carried out quite easily and cost-efficiently.

In connection with this description, in addition to paper, the term "paper" also refers to paper board, tissue, and pulp.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
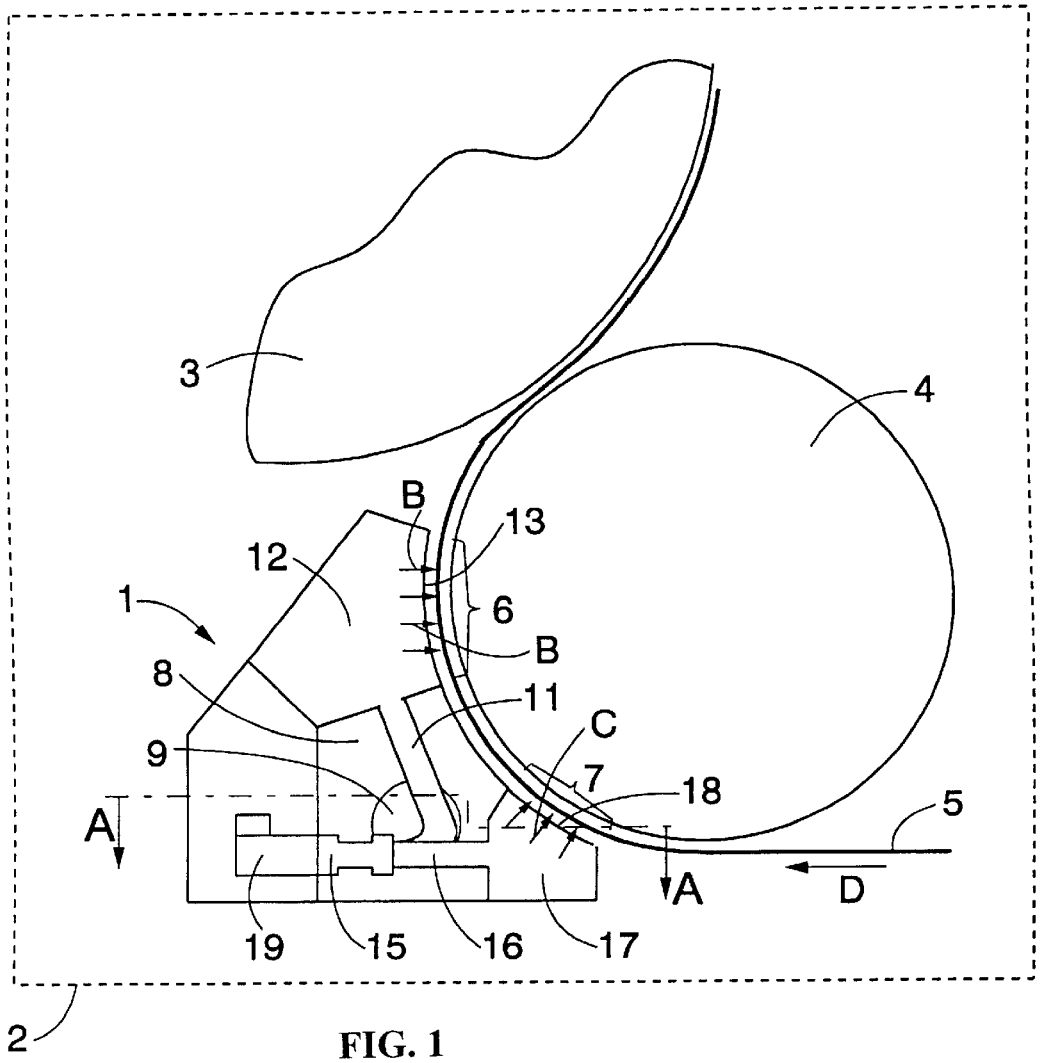
FIG. 1 is a schematic, cross-sectional side view of a steam box of the invention.

FIG. 1 shows a steam box 1 of a paper machine. The steam box 1 in FIG. 1 is arranged in connection with a roll 4 in the paper machine 2 in order to blow steam to a paper web 5. In the press section, for example, the roll 4 is typically a press suction roll in connection with a center roll 3. The steam box 1 of the invention may be arranged in the press section in the paper machine 2, and/or at some other point in the paper machine 2, such as the wire section, drying section, or calender section. At a calender, the steam box 1 may be arranged, for example, in every other roll arranged on top of each other. The paper machine 2 is schematically designated by a broken line, and FIG. 1 lacks the rest of the parts of the paper machine 2 since the structure and operation of the paper machine 2 is not essential to explain the principles of the present invention.

The steam box 1 comprises a main steam zone 6. At the main steam zone 6, separation walls are used for dividing the steam box 1 into several sections in a cross direction with respect to the direction of travel of the paper web 5 shown by arrow D. Hence, the characteristics of the paper web 5 can be adjusted in its cross direction as desired, i.e., the main steam zone 6 forms a profiling zone in the steam box 1. The steam conveyed through the main steam zone 6 enables the temperature of the paper web 5 to be adjusted, the temperature and the press nips and the like located after the steam box together affecting the dry solids content.

The steam box 1 also comprises a side steam zone 7, which, utilizing steam, is responsible for forming a curtain to prevent the air carried with the paper web 5 from being carried along between the steam box 1 and the paper web 5. In addition to or in place of this, the side steam zone 7 may be responsible for preventing steam from exiting between the steam box 1 and the paper web 5 when the side steam zone 7 is arranged after the main steam zone 6 with respect to the direction of travel D of the paper web. Furthermore, the side steam zone 7 may also be used for preheating the paper web 5 and, if desired, also for correcting the average distortion of the moisture profile of the paper web 5.

Figure 2:
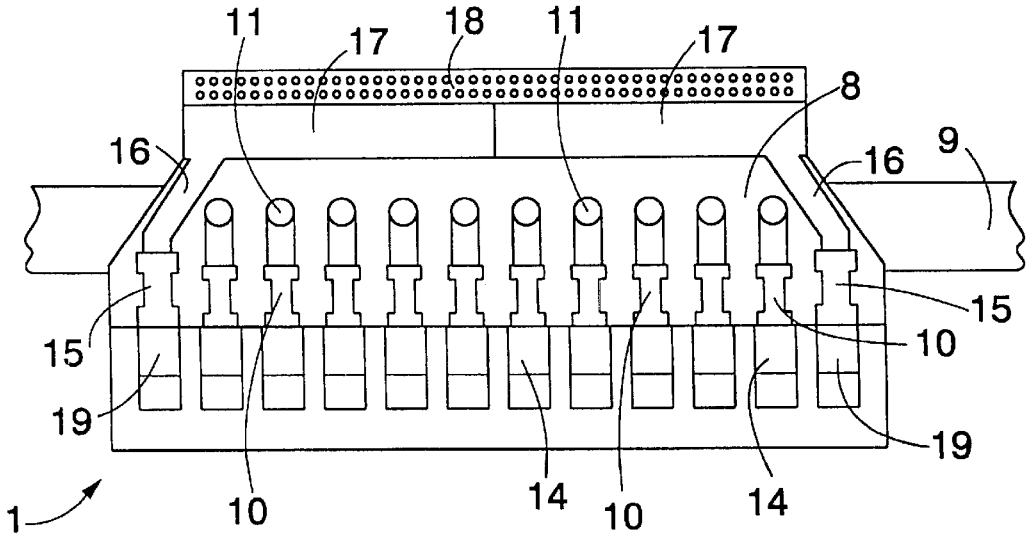
FIG. 2 is a cross-sectional top view of the steam box according to FIG. 1 taken along line A—A.

Steam is supplied to a steam chamber 8 of the steam box 1 through a steam supply pipe 9 outside the steam box 1. Adjustable valves 10 are arranged in the steam chamber 8 as, for example, shown in FIG. 2. The valves 10 are depicted as being much larger with respect to the size of the steam box 1; in actual existence the number of valves 10 in the steam box 1 is thus in practice much larger than that shown in FIG. 2. A typical steam box may, for example, comprise 30 to 200 valves 10. The steam in the steam chamber 8 is supplied through the valves 10 to channels 11 and further to profiling chambers 12. The steam box comprises as many profiling chambers 12 as there are profiling valves 10. Comprising several apertures through which steam is allowed to flow according to arrows B to the paper web 5, a diffusion plate 13 forms one wall of the profiling chamber 12. Each valve 10 is adjusted by a remotely controlled profiling actuator 14. It is then possible to adjust the amount of steam flowing into each profiling chamber 12; consequently, the amount of steam affecting the paper web 5 in a cross direction with respect to the direction of travel of the paper web 5 can also be adjusted in great detail.

Side steam zone valves 15 are also arranged in the steam chamber 8. Through the side steam zone valves 15, steam is supplied to a chamber 17 through a channel 16. One wall of the chamber 17 is formed by a diffusion plate 18, whereby steam is allowed to flow over the width of the chamber 17 to the paper web 5 as shown by arrows C. In the embodiment of the accompanying drawings, the steam box 1 comprises two chambers 17, which means that the side steam zone 7 is divided into two sections. The side steam zone 7 may then be used for supplying a different amount of steam to the back side and the front side of the paper machine, thus enabling correction of a distorted moisture profile of the paper web 5. The side steam zone 7 may also consist of one section only or, if desired, it may be divided into three or even more sections in a cross direction of the web. The side steam zone valve 15 is adjusted by a remotely controlled side steam zone actuator 19. Since the chamber 17 is typically larger than the profiling chamber 12, the side steam zone valve 15 must typically also be larger than the profiling valve 10. Nevertheless, the profiling actuators 14 and the side steam zone actuators 19 may be identical in structure. The actuators may be electromechanical or pneumatic, for example. By using remotely controlled actuators, the control system of the paper machine can readily be provided with feedback from the actuators, which enables the position of the actuators and valves to be quite accurately determined at all times. Consequently, the amount of steam supplied through each valve can then be accurately determined and the profile of the paper web 5 thus quickly and exactly adjusted by the steam box 1. Remote control refers to the fact that control procedures can be carried out outside the steam box. A control command may be given by the control system of the paper machine, for example, and conveyed to the actuator through a cable, for example. For the sake of clarity, the accompanying figures lack a control system and cabling. Preferably, the actuators 19 of the side steam zone are placed substantially in the same space as the profiling actuators 14, in which case the steam box 1 of the invention is larger than a prior art steam box only in a cross direction with respect to the direction of travel of the paper web 5, whereas the cross-section of the steam box 1 shown in FIG. 1 does not substantially differ in size from a cross-section of the prior art steam box.

Figure 3:
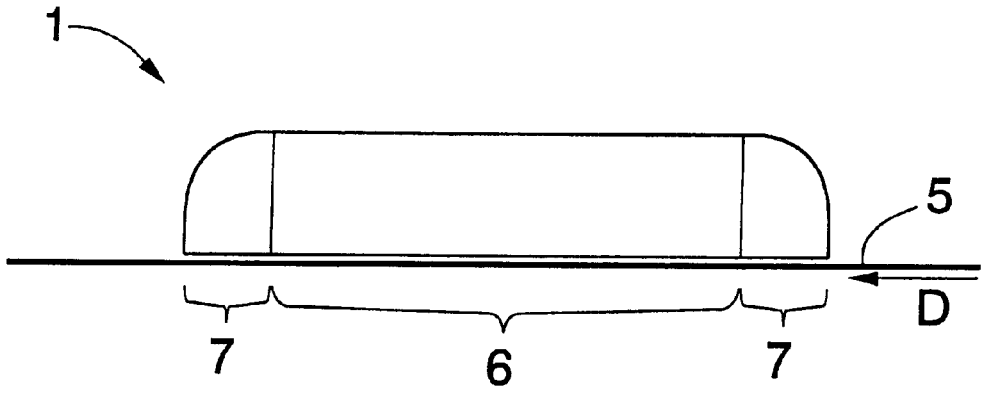
FIG. 3 is a schematic side view of a second steam box of the invention arranged in a wire section of a paper machine.

FIG. 3 shows a planar steam box 1 arranged in the wire section of a paper machine. The steam box 1 comprises a side steam zone 7, the amount of steam supplied from the side steam zone 7 being adjustable, arranged first in the direction of travel of a paper web 5, the side steam box 7 being responsible for preventing air from entering between the steam box 1 and the paper web 5. A main steam zone 6 is provided in the middle of the steam box and a second side steam zone 7 arranged last in the direction of travel D of the paper web 5, and in each operating situation a proper amount of steam is supplied to the second side steam zone 7 by adjusting the amount of steam in the side steam zone according to the volume of production of the paper and/or board machine. The second side steam zone 7 is then arranged to prevent steam from exiting between the steam box 1 and the paper web 5 from the particular side of the steam box. In some embodiments, the amount of steam supplied from the second side steam zone may also be adjustable in a similar manner to that of the first side steam zone 7.

The drawings and the related description are only intended to illustrate the idea of the invention. In its details, the invention may vary within the scope of the claims. Hence, the steam box 1 may comprise, in addition to the main steam zone 6, only one side steam zone 7 arranged after the main steam zone 6 in the direction of travel D of the paper web 5. In such a case, the side steam web 7 is responsible for preventing steam from exiting between the steam box 1 and the paper web 5. The steam box may further comprise the side steam zone 7, the amount of steam supplied from the side steam zone 7 being adjustable, arranged first in the direction of travel of the paper web 5, as shown in FIG. 1, the main steam zone 6 arranged in the middle and a third steam zone, i.e., a second side steam zone, arranged last in the direction of travel of the paper web 5, from which zone substantially the same amount of steam is supplied in each operating situation. In some embodiments, the amount of steam supplied from the third steam zone may also be adjusted. Furthermore, the main steam zone 6 may comprise more than one section such that, for example, a substantially constant amount of steam is supplied from the first section of the main steam zone 6 while the amount of steam supplied from the second section is adjusted. Further, the steam box may have such a structure that from the steam chamber the steam is supplied through the channel to the valve, in which case the valve is located in the profiling chamber as disclosed in U.S. Pat. No. 4,915,788, for example. The structure of the steam box may also be such that the steam chamber is arranged in the middle of the profiling chambers as disclosed in U.S. Pat. No. 4,662,398, for example.

What is claimed is:

1. A steam box of a paper machine for applying steam to a paper web traveling therein, the steam box comprising a steam chamber, a main steam zone, at least one side steam zone and at least one adjustable side steam zone valve, wherein steam is supplied to the main steam zone from the steam chamber, steam is supplied to the side steam zone through the side steam zone valve from the steam chamber and the side steam zone valve is arranged inside the steam box.

2. A steam box as claimed in claim 1, wherein the steam box comprises, adjustable main steam zone valves for supplying steam to the main steam zone from the steam chamber.

3. A steam box as claimed in claim 2, wherein the steam box comprises remotely controlled profiling actuators for adjusting the main steam zone valves supplying steam to the main steam zone and at least one remotely controlled side steam zone actuator for adjusting the side steam zone valve.

4. A steam box as claimed in claim 3, wherein the profiling actuators and the side steam zone actuator are arranged in the same space inside the steam box.

5. A steam box as claimed in claim 3, wherein the profiling actuators and the side steam zone actuator are identical in structure.

6. A steam box as claimed in claim 3, wherein the actuators are electromechanical actuators.

7. A steam box as claimed in claim 1, wherein the side steam zone valve is arranged in the steam chamber.

8. A steam box as claimed in claim 1, wherein the side steam zone is divided into at least two sections in a cross direction with respect to the direction of travel of a paper web.

9. A steam box as claimed in claim 1, wherein the side steam zone is arranged in a side section of the steam box prior to the main steam zone in the direction of travel of the paper web.

10. A steam box as claimed in claim 9, wherein the side steam zone is arranged to prevent air from entering between the steam box and the paper web.

11. A steam box as claimed in claim 1, wherein the side steam zone is arranged in a side section of the steam box after the main steam zone in the direction of travel of the paper web.

12. A steam box as claimed in claim 11, wherein the side steam zone is arranged to prevent steam from exiting between the steam box and the paper web.

13. A steam box as claimed in claim 1, wherein the steam box comprises two side steam zones, wherein the first side steam zone is arranged in a side section of the steam box prior to the main steam zone in the direction of travel of the paper web and the second side steam zone is arranged after the main steam zone.

14. A steam box as claimed in claim 1, wherein the steam box is arranged in the press section of the paper machine.

15. A steam box as claimed in claim 1, wherein the steam box is arranged in a wire section of the paper machine.

16. A steam box as claimed in claim 3, wherein the actuators are pneumatic actuators.

17. A steam box as claimed in claim 1, wherein the steam box is arranged in a drying section of the paper machine.

18. A steam box as claimed in claim 1, wherein the steam box is arranged in a calender section of the paper machine.

* * * * *

UNITED STATES PATENT AND TRADEMARK OFFICE

CERTIFICATE OF CORRECTION

PATENT NO. : 6,412,189 B1
DATED : July 2, 2002
INVENTOR(S) : Pellinen

It is certified that error appears in the above-identified patent and that said Letters Patent is hereby corrected as shown below:

Title page,
Insert the following:

-- [30] Foreign Application Priority Data
Oct. 21, 1999 (FI) 19992284 --.

Item [56], References Cited, U.S. PATENT DOCUMENTS,
"Ivespää" should read -- Ilvespää --.

Signed and Sealed this

Seventeenth Day of December, 2002

JAMES E. ROGAN
*Director of the United States Patent and Trademark Office*